United States Patent [19]

Schultes et al.

[11] 4,105,039

[45] Aug. 8, 1978

[54] SHORTENABLE UMBRELLA

[75] Inventors: Tilmann Schultes; Joachim Seidel, both of Solingen, Fed. Rep. of Germany

[73] Assignee: Kortenbach & Rauh Kommanditgesellschaft, Solingen, Fed. Rep. of Germany

[21] Appl. No.: 804,449

[22] Filed: Jun. 7, 1977

[30] Foreign Application Priority Data

Jun. 12, 1976 [DE] Fed. Rep. of Germany ..... 2626478

[51] Int. Cl.[2] ..... A45B 19/10

[52] U.S. Cl. ..... 135/25 A; 135/26

[58] Field of Search ..... 135/25 R, 25 A, 26

[56] References Cited

U.S. PATENT DOCUMENTS

| | | | |
|---|---|---|---|
| 1,249,007 | 12/1917 | Block | 135/25 R |
| 2,649,103 | 8/1953 | Militano | 135/25 R |
| 3,457,931 | 7/1969 | Shimizu | 135/26 |
| 4,030,514 | 6/1977 | Schultes | 135/25 R |

*Primary Examiner*—Price C. Faw, Jr.
*Assistant Examiner*—Conrad L. Berman
*Attorney, Agent, or Firm*—Martin A. Farber

[57] ABSTRACT

A shortenable umbrella with blades carrying the umbrella canopy, the blades being shortenable by telescoping and/or folding, wherein the innermost blade parts are pivoted on a crown secured on the shortenable rod assembly. The blades are horizontally pivotable by a fork means and a slider means such that each outermost blade part is foldably articulated on the adjacent blade part by a control rod which acts on an extension of the outermost blade part. The umbrella is characterized in that the inner end of each control rod engages in back of the associated fork with direct contact and is articulated on a guide member which effects a guiding of the control rod on a limited path along the fork.

8 Claims, 8 Drawing Figures

Figure 6:
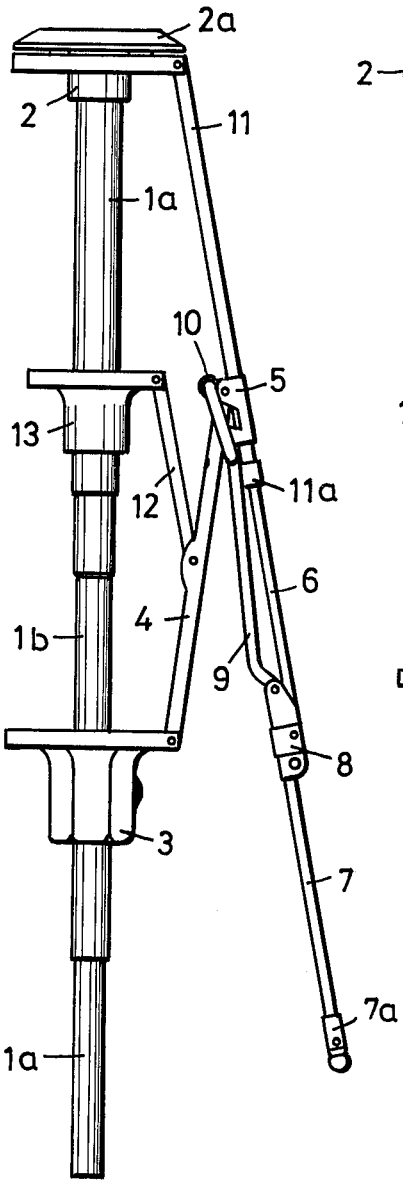

Fig.4
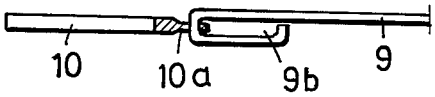
Fig.1
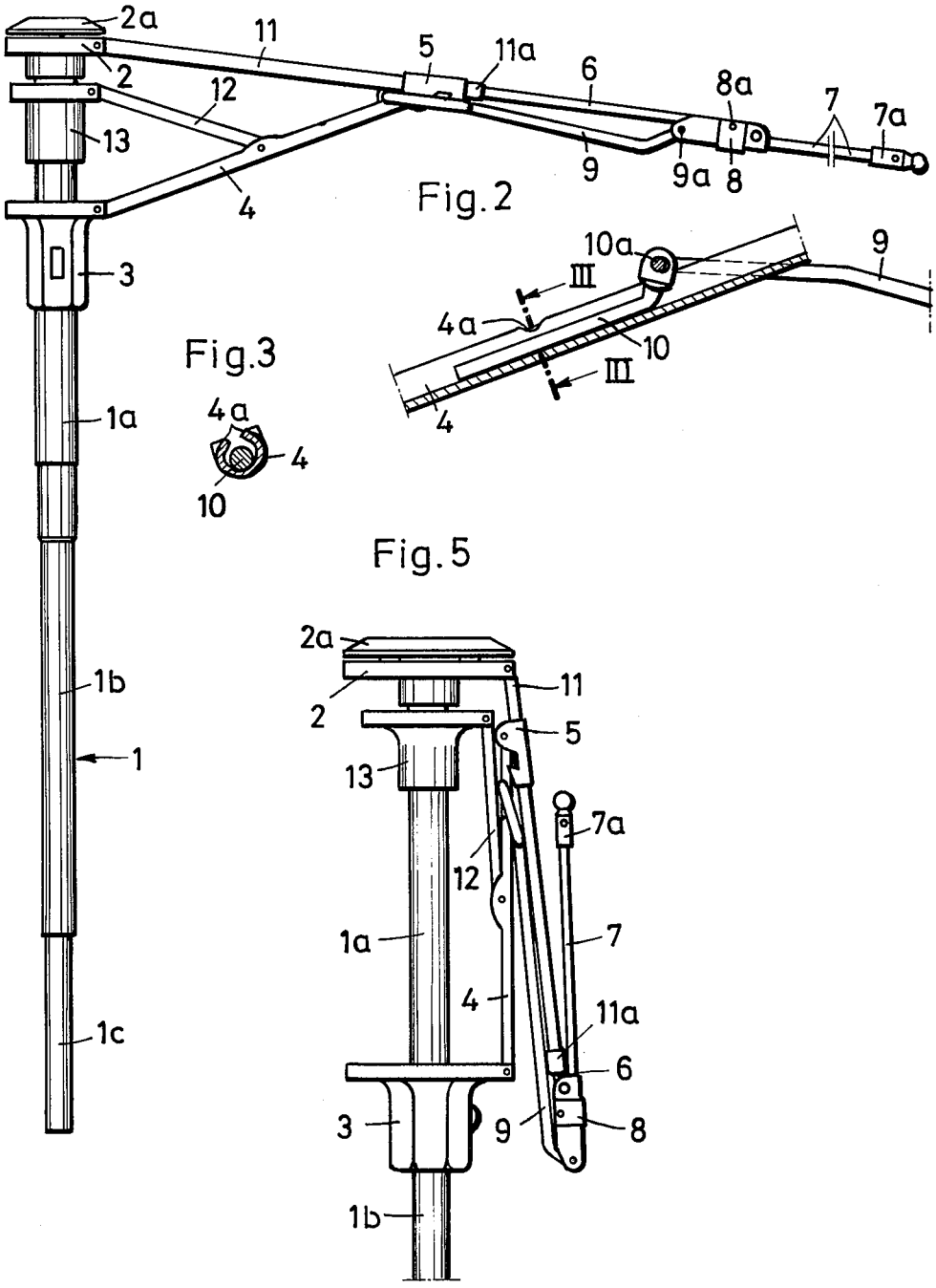
Fig.2
Fig.3
Fig.5

SHORTENABLE UMBRELLA

The invention relates to a shortenable umbrella with blades carrying the umbrella canopy. The blades are shortenable by telescoping and/or folding, wherein the innermost blade parts are pivoted on a crown secured on the shortenable rod assembly. The blades, are horizontally pivotable by a fork means and a slider means such that each outermost blade part is foldably articulated on the adjacent blade part by a control rod acting on an extension of the outermost blade part.

Shortenable or contractable umbrellas of the previously mentioned type are known with telescopic canopy rod ribs or blades as well as with scissors-like joint folding or collapsible frame blades. With both designs the folded down blade parts have a tendency during the opening of the umbrella to fold back into the folded-up position, whereby the outer ring of the umbrella canopy is folded up. This is eliminated by the known embodiments by use of control rods which engage, respectively, on an extension of the outermost foldable-down blade part and force a positive or constrained folding down movement of this outermost blade part during opening of the umbrella.

In order to adjust the course of movement, which was produced by the control rods, to the movement of the remaining frame parts, with the known embodiments it was necessary either to use resilient intermediate elements or to provide an elongated hole connection between the outer end of the control rod and the extension on the inner end of the foldable blade part. Whereas the design with an elongated hole connection has the disadvantage that the folding of the outermost blade parts is imperfectly controlled, the resilient intermediate elements are expensive to produce and to assemble, further it is particularly susceptible to trouble or failure.

In order to avoid these disadvantages, and to effect a positive folding-down of the outermost blade parts without the use of resilient intermediate elements or to effect the elongated hole connections which compensate the control movement, it has been proposed to pivotally fasten each of the inner ends of the control rods on a slide hinge which is articulated on the fork by a connection rod. In this manner, by fixed connections, an early folding-down of the outermost blade parts is achieved and the outermost umbrella cover ring is prevented from folding back.

By the use of control rods, it is not possible with the above-mentioned embodiments to close the umbrella while the outermost blade parts are folded-down. Such a condition with a folded-up umbrella canopy and fully extended frame parts is desired when the umbrella cover is to be dry after use, without the possibility of opening the umbrella canopy.

The invention is based on the task, with a shortenable umbrella of the introductory described type, while keeping an early folding-down of the outermost blade parts during the opening of the umbrella, to provide the possibility during the closing of the umbrella to selectively move the outermost blade parts into the folded-down position or to fold-back the outermost blade parts for engagement or abutment on the adjacent blade parts. Simultaneously it is to be guaranteed that with an unloaded control rod, its inner end is not freely mobile, so that rattling is prevented.

This task is solved with the invention in the manner that the inner end of each control rod engages in back of the associated fork with direct contact and is articulated on a guide member which effects a guiding of the control rod on a limited path along the fork.

With this proposal of the present invention, the advantage is achieved that by the direct contact between the fork and the control rod, the control movement of the control rod for the folding part is transferred or transmitted without the insertion or intermediary of slides, which slides not only produce additional friction, but also clamping forces with a noncentral force action, whereby such type of central force action can not be performed in practice. By the guide member, furthermore, a guiding is achieved, which on the one hand prevents uncontrollable movements, and on the other hand assumes no forces, so that jamming is avoided. Since such a type of a guiding is achieved only on a limited path in the longitudinal direction of the fork, and a lifting of the guide rod from the fork is prevented here, the guide member in accordance with the invention is operative only with an unloaded or detensioned control rod. In this manner, the friction forces are negligibly small.

According to a further feature of the invention, the inner end of the control rod can be formed into a large area opening. In this manner, no edge arises and sufficiently freer or more open space is present for horizontal pivoting with the closed umbrella.

The part of the control rod, which part forms the opening, according to a further feature of the invention can be bent at an acute angle with respect to the longitudinal direction of the control rod. In this manner, the opening becomes smaller as a consequence of the inclined position, and with an opened umbrella, a press-back or squeezing-off action results. This distortion or bracing causes an abutment or engagement on two points and in this manner avoids rattling as well as lateral displacement with the opened umbrella.

With a preferred embodiment, the guide member can be a formed part which is guided displaceably in the fork, the latter being formed with a U-shaped crosssection. The end of the control rod which engages behind the fork is articulated on the outer end of the formed part. A favorable relationship of the guide length relative to the guide width is thereby achieved and every type of clamping is prevented. Moreover, for direct contact between the fork and control rod, the required play is easy to produce.

In accordance with the invention, the formed part can be a round wire with an attached articulated end formed thereon. Furthermore, it is possible to form the U-shaped fork with an indentation or embossment in relief for the guidance and path limitation of the guide member.

Figure 7:
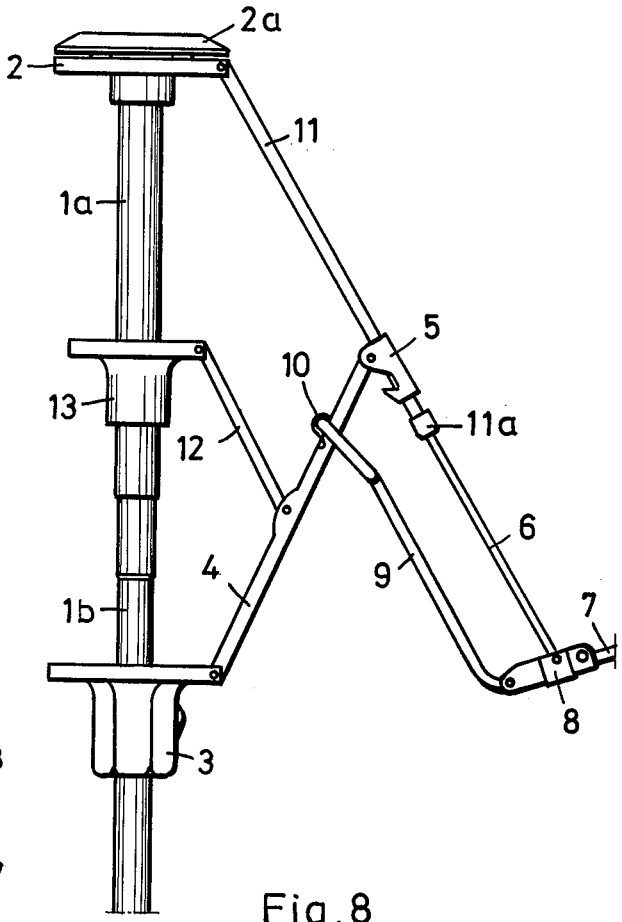
Figure 8:
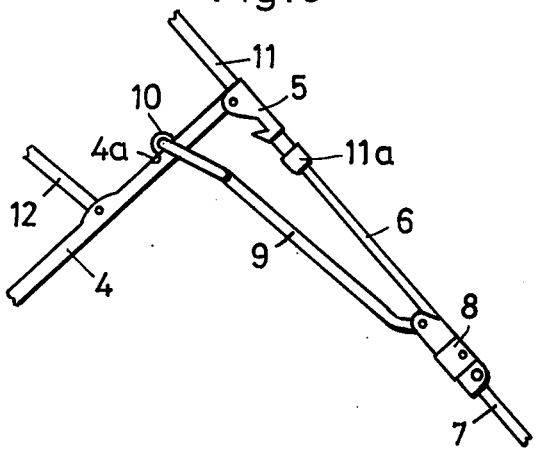

One preferred embodiment example of the invention is illustrated in the drawing, which shows FIG. 1 a three fold shortenable umbrella in the stretched out condition;

FIG. 2 a partially sectioned detail illustrated in larger scale;

FIG. 3 a cross-section according to the section line III—III in FIG. 2;

FIG. 4 a plan view of the illustration in FIG. 2;

FIG. 5 a side view of the umbrella according to FIG. 1 in a completely closed condition;

FIG. 6 a side view of the umbrella with extended and folded-up frame parts in the almost closed condition;

FIG. 7 a side view corresponding to FIG. 6 during the opening of the umbrella; and FIG. 8 a part of the umbrella according to FIG. 7 with a further advanced opening movement.

The illustrated embodiment relates to a so-called flat umbrella with a three part rod assembly 1 which comprises an outer tube 1*a*, a center tube 1*b*, and an inner tube 1*c*, which are telescopically guided within each other. A crown 2 is secured at the free end of the outer tube 1*a*, on which crown the umbrella cover, which is not illustrated in the drawing, is fixed by means of a cap or top 2*a*. Further, a slider 3 is moveably arranged on the outer tube 1*a* of the rod assembly 1. A plurality of forks 4 are articulated to the slider 3. Only one fork 4 is completely illustrated in the drawings for the sake of an improved overall view.

The outer end of each fork 4 is articulated on a hinge 5, the latter being fastened on the inner-lying end of a middle blade part 6. A folding hinge 8 is articulated by means of a folding pin 8*a* on the outer end of this blade part 6. The folding hinge 8 is attached to the inner end of an outermost blade part 7. The outermost blade part 7 is arranged so as to be foldable on the middle blade part 6 with the aid of the folding hinge 8, whereby the folding movement can be controlled by means of a control rod 9 which is articulated by means of a pivot or hinge pin 9*a* on that part of the folding hinge 8 which extends inwardly beyond the folding pin 8*a*. For fastening of the umbrella cover, each outermost blade part 7 is provided with a blade top end cap 7*a*, which likewise as the folding hinge 8 is equipped with a sew-on or tie-on hole for the umbrella cover.

The inner end of each control rod 9 engages around the fork 4 which is coordinated thereto, by means of a guide opening 9*b*, and indeed with direct contact with the fork 4. The control rod 9 moreover is connected with a guide member 10, which makes possible a displacement of the inner end of the control rod 9 in the longitudinal direction of the fork 4 on a limited path, yet preventing a lifting or raising of the control rod 9 from the fork 4. With the illustrated embodiment, the guide member 10 is constructed as a formed part displaceably guided in the fork 4. The fork is formed with a U-shaped cross-section. The outer end of the formed part 10 is articulated on that end of the control rod 9 which engages behind the fork 4. This guide member 10 has an articulation eye 10*a* and is produced from a rounded wire or wire rod. The displacement movement of the guide member 10 inside of the fork 4 is limited by embossments or press-on indentations 4*a*. The eye 10*a* of guide member 10 abuttingly engages on these indentations. These inwardly directed projection portions, embossments or indentations 4*a* are best seen in FIGS. 2 and 3.

The flat telescopic umbrella furthermore has an innermost blade part 11. The middle blade part 6 telescopically can be pushed in the innermost blade part 11. This innermost blade part 11 is pivotally articulated with its inner end on the crown 2. The blade part 11 on the outermost end carries a small band 11*a* against which the hinge 5 comes into contact or engagement with an opened umbrella, as illustrated in FIG. 1. The hinge 5 is fastened to the middle blade part 6. Finally with the illustrated embodiment, the umbrella has auxiliary forks 12 which are articulated on the forks 4. The auxiliary forks 12 are horizontally pivotable by means of an auxiliary slider 13. With an opened umbrella with a stretched-out umbrella cover, that inner end of the control rod 9 which is articulated on the articulation eye 10*a* of the guide member 10, lies in the vertex of the acute angle which is formed by the fork 4 and the innermost blade part 11. In this position, movement of the control rod 9 is prevented, so that the foldable-down outermost blade part 7 remains in the unfolded position as illustrated in FIG. 1. The non-planar bending-off (seen in the Figures) of the part forming the guide opening 9*b* of the control rod 9 relative to the remainder of the control rod 9 guarantees that in this position the control rod 9 comes into contact or engagement on two points on the remaining frame parts. Consequently rattling is prevented as well as lateral displacement of the control rod 9 with respect to the remaining parts of the umbrella frame.

With a closed umbrella is in the folded-up condition according to FIGS. 5 and 6, the possibility exists, either to move the outermost blade parts 7 into the folded-down position according to FIG. 6, or to fold-up the outermost blade parts 7 on the middle blade parts 6 according to FIG. 5. This possiblity occurs by the large area, guide opening 9*b* and the displaceability of the inner end of the control rod 9 in the longitudinal direction of the corresponding fork 4. The user of the umbrella consequently has the choice of folding the outer ring of the umbrella cover back or moving it into the extended position. The outer ring is fastened on the folding hinge 8 and the pole cap 7*a*.

In spite of the possibility to move the control rod 9 with respect to the fork 4, during the opening of the umbrella, a control movement for the outermost blade parts 7 automatically occurs, which moves these parts quickly into the folded-down position, as this is seen in FIGS. 6–8. At the beginning of the opening operation, as illustrated in FIG. 7, the control rod 9 slides with the guide member 10 on the associated fork 4 in the direction toward the slider 3. When of the rear end of the control rod 9 moves away from the hinge 5 to provide a large space, a greater lever arm is produced for the folding movement, the latter which is exerted on the outermost blade part 7 by the control rod 9; so that the outermost blade part 7 is folded-down very early from its parallel position to the middle blade part 6. This movement not only prevents a lagging of the outer ring of the umbrella, but rather favors the movement during the opening of the umbrella canopy. Only near the end of the opening movement, does the inner end of the control rod 9, according to FIG. 8, slide back on the fork 4 in the direction toward the hinge 5, whereby the necessary equalization or compensation of movement occurs, with respect to the folding movement. With a completely opened umbrella according to FIG. 1, the inner end of the control rod 9 with the guide member 10 lies directly abutting the hinge 5.

By the direct contact between the fork 4 and the control rod 9, the control movement of the control rod 9 is moved for the folding movement of the outermost blade part 7 without the intermediary or insertion of any such slides which can exert clamping forces in addition to further friction. The guide member 10 fulfills its guide task, namely a lifting or raising of the inner end of the control rod 9 from the fork 4 only with an unloaded control rod 9. It consequently prevents a rattling of the guide opening 9*b* on the fork 4, without producing friction forces during the control movement.

While we have disclosed one embodiment of the invention, it is to be understood that this embodiment is given by example only and not in a limiting sense.

We claim:

1. A shortenable umbrella having blades carrying the umbrella canopy, the blades being shortenable by telescoping and/or folding, and having a shortenable rod assembly and a crown secured on the shortenable rod assembly and for each innermost blade at least one fork operatively connected by means of at least one slider, the latter displaceably disposed on the shortenable rod assembly, for pivoting the blades, comprising a plurality of the following combination an innermost blade being pivoted on the crown, an outermost blade having an extension, a middle blade operatively connected to said innermost and outermost blades, respectively, a fork being operatively connected to said blades and to the slider, a control rod operatively connected to said extension of said outermost blade, said outermost blade being hinged foldably onto said middle blade and actuatable therefor by means of said control rod, said control rod having an inner end engaging behind said fork with direct contact, guide member means for guiding said control rod on a limited path along said fork, said inner end of said control rod being articulated on said guide member means.

2. The umbrella according to claim 1, wherein said inner end of said control rod is formed into a large area guide opening, said fork extends through said guide opening.

3. The umbrella according to claim 1, wherein said control rod includes a portion forming said guide opening, said portion is bent-off at an acute angle with respect to a longitudinal direction of said control rod.

4. The umbrella according to claim 1, wherein said middle blade is telescopically connected to said innermost blade, and said fork is pivotally connected to an innermost end of said middle blade.

5. The umbrella according to claim 1, wherein said guide member means is formed as a shaped part, said fork is formed with a U-shaped cross-section, said shaped part is displaceably guided within said U-shaped cross-section of said fork, said shaped part has an outer end, said inner end of said control rod which engages behind said fork is articulated on said outer end of said shaped part.

6. The umbrella according to claim 5, wherein said shaped part is a round wire formed at said outer end thereof with an articulation eye thereon, the latter being articulated to said inner end of said control rod.

7. The umbrella according to claim 5, wherein said U-shaped fork is formed with indentation means for guiding and limiting the path of said guide member means.

8. The umbrella according to claim 7, wherein said U-shaped cross-section of said fork includes two legs of the U-shaped cross-section, said indentation means constitutes pressed-in ends of said two legs of the U-shaped cross-section of said fork at a portion thereof, said shaped part slidably extends in said fork passing under said pressed-in ends, the latter having a spacing smaller than the diameter of said shaped part, said outer end of said shaped part abuts said pressed-in ends in one end position thereof, thereby limiting the slidable movement of said shaped part relative to said fork.

* * * * *